US011601741B1

(12) United States Patent
Meyberg Guzman et al.

(10) Patent No.: US 11,601,741 B1
(45) Date of Patent: Mar. 7, 2023

(54) MONAURAL HEADSET WITH TWO EARPHONES

(71) Applicant: Plantronics, Inc., Santa Cruz, CA (US)

(72) Inventors: Jacob T. Meyberg Guzman, Santa Cruz, CA (US); John Kelley, Wailea, HI (US); Darrin Caddes, Soquel, CA (US)

(73) Assignee: PLANTRONICS, INC., Santa Cruz, CA (US)

( * ) Notice: Subject to any disclaimer, the term of this patent is extended or adjusted under 35 U.S.C. 154(b) by 0 days.

(21) Appl. No.: 17/507,444

(22) Filed: Oct. 21, 2021

(51) Int. Cl.
*H04R 25/00* (2006.01)
*H04R 1/10* (2006.01)
*H04R 1/34* (2006.01)

(52) U.S. Cl.
CPC ..... *H04R 1/1008* (2013.01); *H04R 1/105* (2013.01); *H04R 1/1083* (2013.01); *H04R 1/345* (2013.01)

(58) Field of Classification Search
CPC ..... H04R 1/105; H04R 1/30; H04R 1/1008; H04R 1/1016
See application file for complete search history.

(56) References Cited

U.S. PATENT DOCUMENTS

| | | | | |
|---|---|---|---|---|
| 5,625,903 | A * | 5/1997 | Schultz | H04R 5/0335 2/209 |
| 8,600,085 | B2 | 12/2013 | Chen | 381/309 |
| 10,334,366 | B2 | 6/2019 | Nakagawa | H04R 5/033 |
| 2010/0020998 | A1 | 1/2010 | Brown | 381/380 |
| 2011/0235819 | A1 * | 9/2011 | Alden | H04R 1/1066 381/384 |
| 2012/0207320 | A1 | 8/2012 | Avital | 381/74 |

* cited by examiner

*Primary Examiner* — Amir H Etesam

(57) ABSTRACT

Improved monaural headsets are provided. In some embodiments, a monaural headset includes: a first earphone with a speaker to provide output audio to a user; a second earphone without a speaker to provide output audio to the user; and a headband, connected to the first earphone and the second earphone; wherein the second earphone includes at least one vent opening, which vent opening during use provides an acoustic path between an environment of the user, wearing the headset, and the user's ear.

17 Claims, 21 Drawing Sheets

MONAURAL HEADSET WITH TWO EARPHONES

FIELD

The present disclosure relates generally to headsets and in particular monaural headsets.

BACKGROUND

Headphones and headsets are ubiquitous today for many applications. Monaural headsets provide audio to one of the user's ears. Applications for monaural headsets include phone/video conferencing and call centers.

Over-the-head monaural headsets typically have a functional side with speaker and microphone. On the other side of the headband, a so-called 'T-pad' is attached and rests above the user's ear. T-pads should stabilize the headset in a comfortable manner if the surface area is large enough and material soft, fitted, or compliant. As the present inventors have ascertained, designing a headset with a T-pad however can take significant time and effort to achieve a comfortable fit.

As the present inventors have also ascertained, T-pads may not be esthetically pleasing. In addition, T-pads may get tangled in a user's hair when wearing the headset, making it difficult and/or painful to don and doff the headset.

As a result, improved monaural headsets are needed.

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

SUMMARY

In general and in a first exemplary aspect, a monaural headset is provided that comprises at least: a first earphone with a speaker to provide output audio to a user; a second earphone without a speaker to provide output audio to the user; and a headband, connected to the first earphone and the second earphone; wherein the second earphone comprises a vent opening, which vent opening during use provides a direct acoustic path between an environment of the user, wearing the headset, and the user's ear.

In general and in a second exemplary aspect, a monaural headset is provided, comprising at least: a first earphone with a speaker; a second earphone; and a headband, connected to the first earphone and the second earphone. The second earphone is speakerless and the second earphone comprises a vent opening, which vent opening provides a direct acoustic path between an environment of a user, wearing the headset, and the user's ear.

In general and in a third exemplary aspect, a monaural headset is provided, comprising at least: a first earphone with a speaker, a second earphone without a speaker, and a headband, connecting the first and second earphones. The second earphone is of open or semi-open type.

The details of one or more embodiments are set forth in the accompanying drawings and the description below. Other features will be apparent from the description, drawings, and from the claims.

DESCRIPTION

Figure 1:
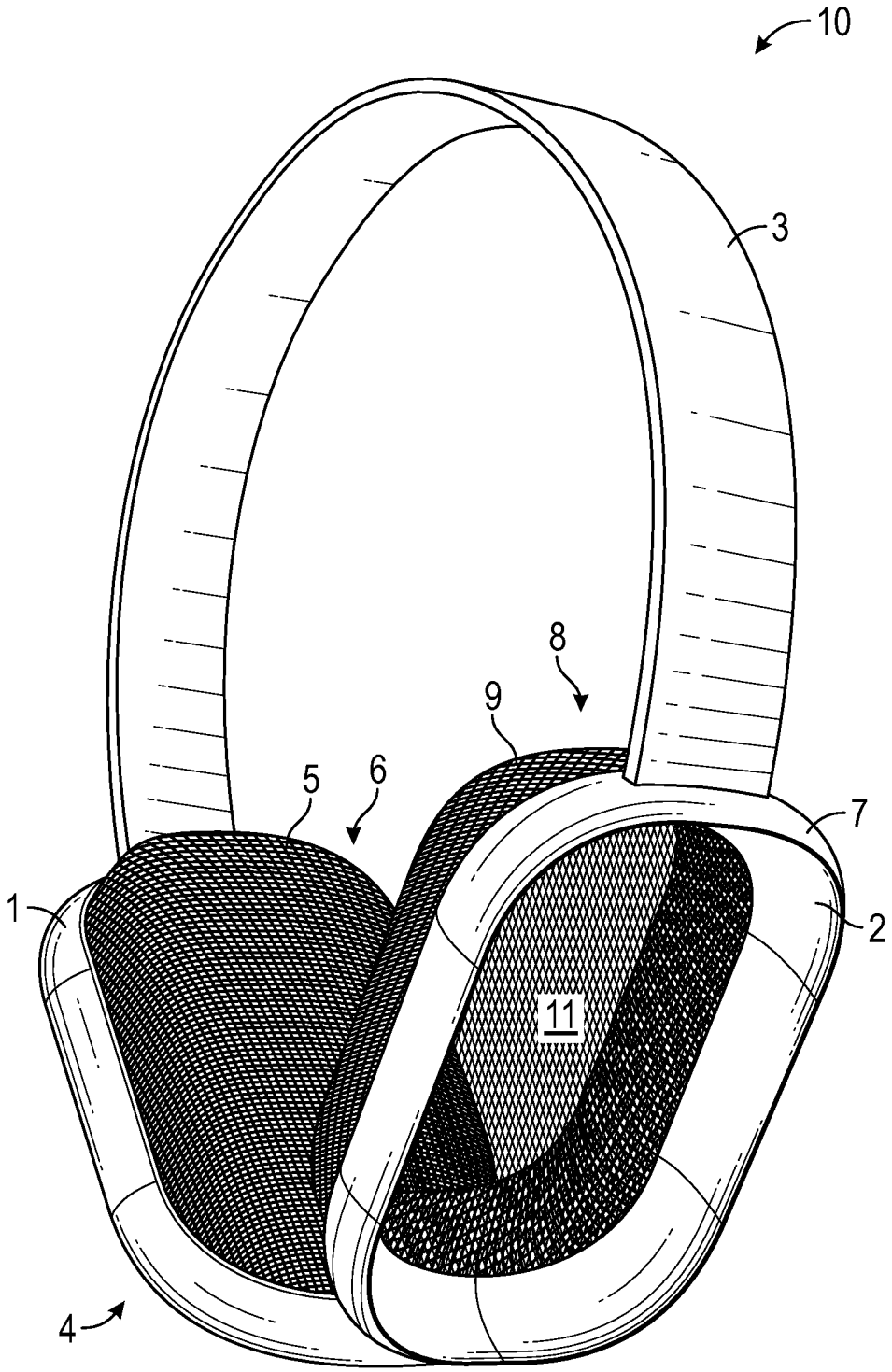
FIG. 1 shows an embodiment of a monaural headset in a schematic perspective view.

As discussed in the preceding, the teachings herein concern improved monaural headsets. According to a first exemplary aspect, a monaural headset includes a first earphone with a speaker to provide output audio to a user, e.g., while wearing the headset, and a second earphone, which second earphone does not comprise a speaker. A headband is connected to the first earphone and the second earphone. Instead of the speaker and in some embodiments, the second earphone includes a vent opening, which vent opening during use provides an acoustic path between the environment of the user, wearing the headset, and the user's ear.

As will be apparent, the headset includes the second earphone instead of the usually employed 'T-pad', which may improve the wearing comfort, stability, and/or aesthetics of the monaural headset.

In the context of this application, the term "headset" refers to all types of headsets, headphones, and other head worn audio playback devices, such as for example circum-aural and supra-aural headphones. A dedicated microphone for recording the user's voice may or may not be provided as part of a headset in the context of this explanation. The headset in some embodiments may comprise an audio processor and/or other electronic circuitry. The audio processor may be of any suitable type to provide output audio from an input audio signal. For example, the audio processor may be a digital sound processor (DSP). The headset may be wireless or wired, i.e., using a cable connection. A monaural headset is understood in the present context to be a mono headset. Circuitry may be provided in some embodiments as a component of the monaural headset to convert a received stereo signal to a mono signal. For example, such a conversion may be conducted by the audio processor, mentioned in the preceding.

As discussed in the preceding, the monaural headset according to the first exemplary aspect includes a first earphone and a second earphone. An 'earphone' in the context of this discussion may generally be of any suitable type and shape to contact the user's ears during use, i.e., when wearing the headset. For example, the earphones in some embodiments may be of circum-aural type (around the ear) or of supra-aural type (resting on the ear). In some embodiments, at least one of the earphones includes an ear cushion that either at least partly surrounds the ear of the user during use or that at least partly is arranged on the ear of the user during use. It is noted that the term 'during use' herein refers to the headset being worn on the user's head. The ear cushion may be of any suitable type. In some embodiments, the ear cushion includes a cover made from cloth, leather, or synthetic leather. In some embodiments, the ear cushion includes an interior padding, such as provided by (memory) foam material.

It is possible in some embodiments that the earphones are of differing types or shapes, i.e., that the first earphone is of a different type or shape, compared to the second earphone. However, and in some embodiments, both, the first and second earphone are of the same type and/or have the same (exterior) shape or design. This is beneficial to reduce the design effort of the headset.

Generally, and according to the first exemplary aspect, the first earphone includes one or more speakers, i.e., speaker drivers or (full band) speakers, while the second earphone is not provided with one or more speakers. In the context of the present discussion, the second earphone is thus also referred to as being 'non-functional' with respect to outputting audio, or as a 'dummy' earphone. It is noted however that the second earphone may comprise components other than one or more speakers, such as one or more microphones, circuitry, processors, or a battery, without limitation. A correspondingly configured second earphone is considered as being 'non-functional' or a 'dummy' herein. In some embodiments, the second earphone includes a human machine interface or user interface. Arranging the human machine interface or user interface may provide increased accessibility and/or improved weight distribution.

In some embodiments, at least one of the earphones includes audio processing circuitry, such as a wireless interface, an audio processor, and/or an audio amplifier. In some embodiments, at least one of the earphones furthermore includes a battery, a user interface, and/or one or more microphones to obtain an audio signal of the user's voice when wearing the headset. The one or more microphones may for example be arranged integrated with at least one of the earphones. Such a setup may be used for example when a headset without a microphone boom is desired. In this case and to achieve high performing transmit for a monaural headset, it may be beneficial in some embodiments to setup both earphones with one or more microphones each. Thus, microphones may be on the first and second earphone, which may be beneficial for both performance and in terms of 're-use' and being able to leverage more directly the acoustic transmit design of a stereo product.

In some embodiments, at least one microphone may be arranged on a microphone boom, connected with one of the earphones or the headband.

According to the first exemplary aspect, the monaural headset includes a headband, which headband is connected to the first earphone and the second earphone. The headband may be of any suitable type and configuration. In some embodiments, the headband is configured to be arranged substantially vertical on the user's head, extending from one ear over the top of the user's head to the respective other ear. In some embodiments, the headband is configured to be arranged substantially horizontally on the user's head, i.e., like a neckband. In some embodiments, the headband extends between the first earphone and the second earphone. In some embodiments, a first end of the headband is coupled to the first earphone and a second end of the headband is coupled to the second earphone.

In some embodiments, the headband may be movable coupled with at least one of the first and second earphones to allow an adjustability to the user's head. In some embodiments, the headband may comprise a length adjustment mechanism allowing an adjustment of the length between a center of the headband and the first earphone and/or the second earphone, respectively. In other words, the position of one or more of the earphones with respect to the center of the headband is adjustable. In some embodiments, the headband includes a cable assembly to connect the first and second earphones.

According to the first exemplary aspect, the second earphone includes at least one vent opening, which vent opening provides an acoustic path between an environment of the user, when wearing the headset, and the respective user's ear. In other words, the second earphone may for example be of 'open' or 'semi-open' type that allows environmental sounds to reach the ear of the user that is otherwise covered by the second earphone. It is noted that the term 'acoustic path' is understood as a passageway for acoustic waves in a fluid medium, such as air.

In some embodiments, the at least one vent opening includes a screen, e.g., a mesh screen. For example, the screen may be made from a woven fabric, non-woven fabric, plastics, paper, metals, or any other material that is permeable to acoustic waves.

In some embodiments, the at least one vent opening includes a closure mechanism for selectively blocking the at least one vent opening. The present embodiments allow the user to reduce the amount of environmental sound that is reaching the respective ear of the user. The closure mechanism may be of any suitable type. For example, the closure mechanism may comprise a hinged door or shutter that is manually or electrically actuatable at least between an open and a closed position to selectively block the at least one vent opening. In some embodiments, the closure mechanism may comprise a louver with multiple hinged slats that can be moved between at least the open and closed positions.

In some embodiments, the closure mechanism may comprise a sliding door in track(s) or groove(s) that may be manually pushed open and shut. In some embodiments, the closure mechanism may comprise a raised or indented handle to help a user to locate and operate the closure mechanism. In some embodiments, the handle is configured to provide friction for the user's fingers. In some embodiments, a dial is used as a closure mechanism to open and shut the vent. In some embodiments, the dial may have a feature (rod or rib arm) that interfaces with the vent such that turning the dial will open and close the at least one vent opening. In some embodiments, the closure mechanism is of toggle type, similar to a light switch that is pressed on one side to open and the other side to close.

In some embodiments, the closure mechanism is configured to provide at least an open position and a closed position, wherein in the open position, the acoustic path is provided and in the closed position the acoustic path is blocked. In some embodiments, the closure mechanism provides positions other than the open and closed positions, so that the user can regulate the amount of environmental sound traveling through the at least one vent opening.

In some embodiments, the at least one vent opening has a size ranging approximately from 10 mm-40 mm in width and/or length (cross-section area approximately 100 $mm^2$ to 1600 $mm^2$). This allows for good spatial hearing of the environment when wearing the headset. In some embodiments, the at least one vent opening is configured to leave the ear canal area of the user (an average user) during use substantially uncovered. For example, the at least one vent opening may be configured, so that in a plane, perpendicular to an axis that extends out horizontally from the user's ear, the outline of the at least one vent opening is larger than the ear canal area of the user's ear. In other words, the user's ear canal along the axis is placed entirely under the vent opening. This configuration provides a superior 'open' feel with respect to the ability to hear environmental sounds, but also with respect to reduced temperature at the user's respective ear.

In some embodiments, the first earphone also includes at least one vent opening.

In some embodiments, the second earphone includes an ear cushion; wherein the ear cushion is substantially ring-shaped around a central axis, wherein the at least one vent opening is formed along the central axis of the ear cushion. The present embodiments include setups, where the vent opening is formed parallel to the central axis of the ear cushion. The ear cushion may be of any suitable type.

In some embodiments, the second earphone may comprise a housing, wherein the housing of the second earphone is connected to the headband. In some embodiments, the ear cushion of the second earphone is connected to the housing. For example, the housing may couple the ear cushion to the headband.

In some embodiments, the housing of the second earphone is substantially ring-shaped around the central axis.

In some embodiments, an exterior configuration of the first earphone is substantially similar to an exterior configuration of the second earphone. For example, the overall size, shape, or outline of the first earphone may correspond to the overall size, shape, or outline of the second earphone. In some embodiments, the exterior configuration of the first earphone is identical to the exterior configuration of the second earphone. The present embodiments facilitate a particularly efficient design and manufacture of the headset.

According to a second exemplary aspect, a monaural headset is provided, comprising at least: a first earphone with a speaker; a second earphone; and a headband, connected to the first earphone and the second earphone; wherein the second earphone is speakerless; and the second earphone includes a vent opening, which vent opening provides a direct acoustic path between an environment of a user, wearing the headset, and the user's ear.

In some embodiments, the headset according to the present exemplary aspect is configured according to one or more of the embodiments of the headset according to the first exemplary aspect.

According to a third exemplary aspect, a monaural headset is provided, comprising at least: a first earphone with a speaker; a second earphone without a speaker; and a headband, connecting the first and second earphones; wherein the second earphone is of open or semi-open type.

In some embodiments, the headset according to the present exemplary aspect is configured according to one or more of the embodiments of the headset according to the first and/or second exemplary aspect.

Reference will now be made to the drawings in which the various elements of embodiments will be given numerical designations and in which further embodiments will be discussed.

In the exemplary embodiments, the described components of the embodiments each represent individual features that are to be considered independent of one another, in the combination as shown or described, and in combinations other than shown or described. In addition, the described embodiments can also be supplemented by features of the invention other than those described.

Figure 2:
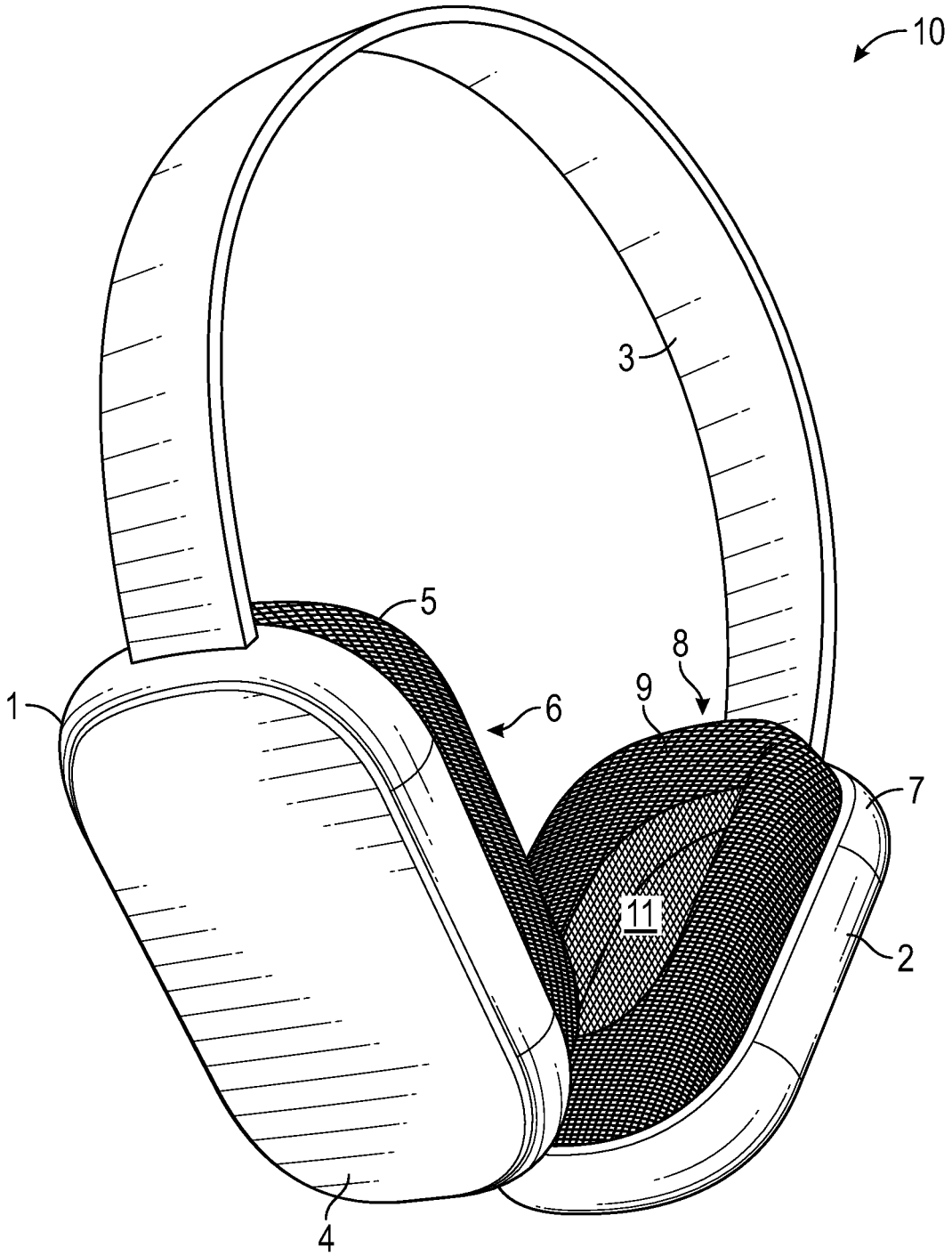
FIG. 2 shows another schematic perspective view of the embodiment of the headset of FIG. 1.

FIGS. 1 and 2 show a first embodiment of a monaural headset 10 in schematic perspective views. The headset 10 is of circum-aural type and includes a first functional earphone 1 and a second non-functional earphone 2, connected with each other by a headband 3.

The first earphone 1 includes a speaker (not shown) to provide output audio to a user during use, i.e., when the user is wearing the headset 10 on their head. The speaker is mounted on an interior side of a closed dome-shaped earcup housing 4. A fabric mesh screen 5 is provided as a cover for the speaker and an ear cushion 6, which is approximately ring-shaped.

The non-functional, second earphone 2 does not comprise a speaker that would provide output audio to the user. The second earphone 2 includes an approximately ring-shaped housing 7 that connects to the headband 3. A correspondingly ring-shaped ear cushion 8 is provided on an interior side of the housing 7. Corresponding to the first earphone 1, a fabric mesh screen 9 is provided as a cover for the ear cushion 8.

As will be apparent from FIGS. 1 and 2, the second earphone 2, and in particular housing 7 and ear cushion 8, form a large vent opening 11. This allows the user during use to hear sounds in their environment and also provides ventilation. Since the monaural headset 10 is designed as a circum-aural headset, the ear cushion during use will be arranged around the user's ear. Correspondingly, the cross-sectional area of the vent opening 11 is relatively large to accommodate the user's ear. The arrangement of the circum-aural second earphone 2, instead of a usually used T-pad (see FIG. 21), provides superior stability and wearing comfort.

Headset 10 according to the present embodiment is a wireless headset. Accordingly, the headset 10 includes a wireless interface (e.g., a Bluetooth interface), control electronics, and an amplifier (all not shown) which are arranged in the first earphone 1. A battery (not shown) can be provided in the second earphone 2 to power all components of the headset. A wiring harness (not shown) between the first earphone 1 and the second earphone 2 is provided inside the headband 3.

Figure 3:
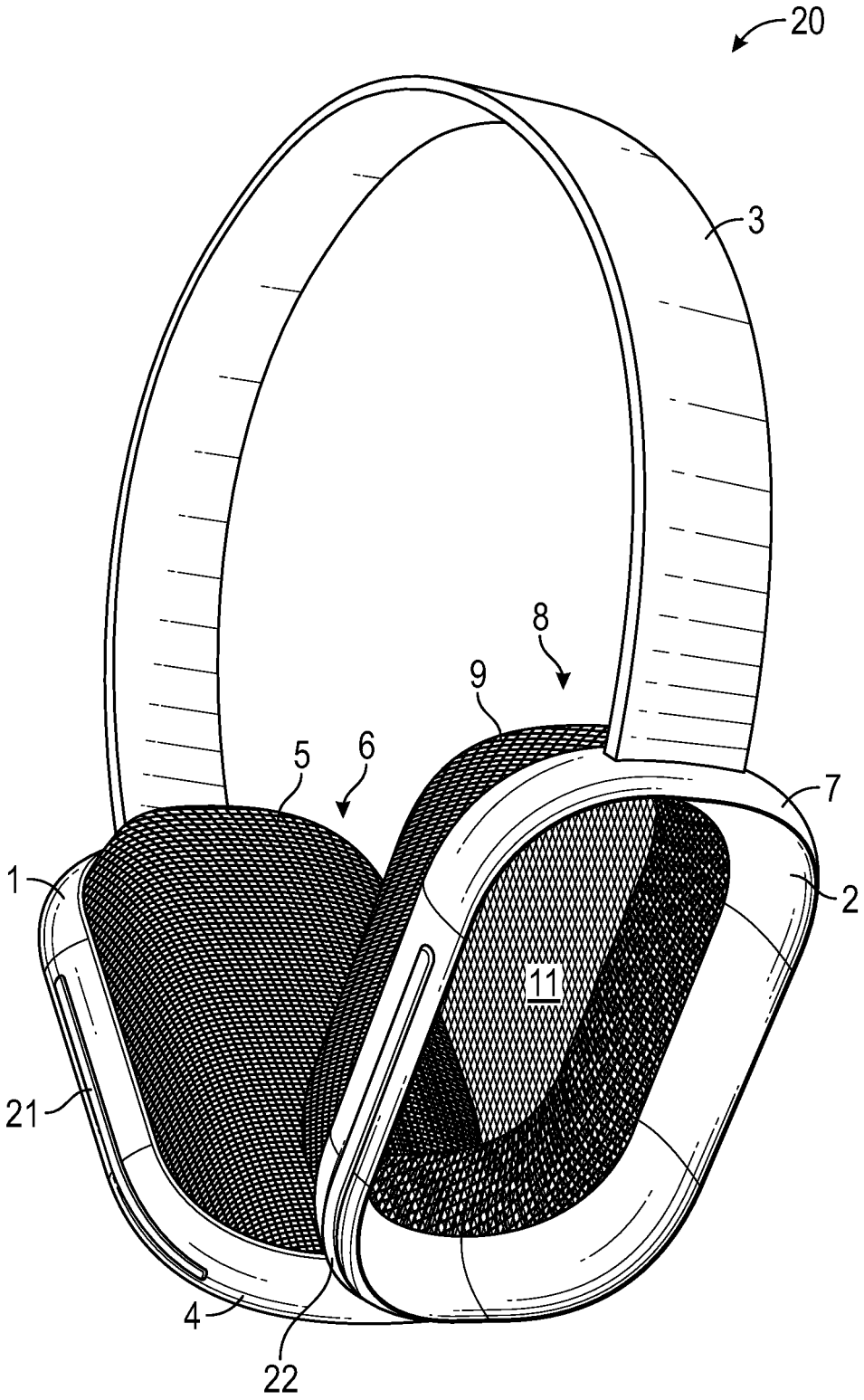
FIG. 3 shows a second embodiment of a monaural headset in a schematic perspective view.
Figure 4:
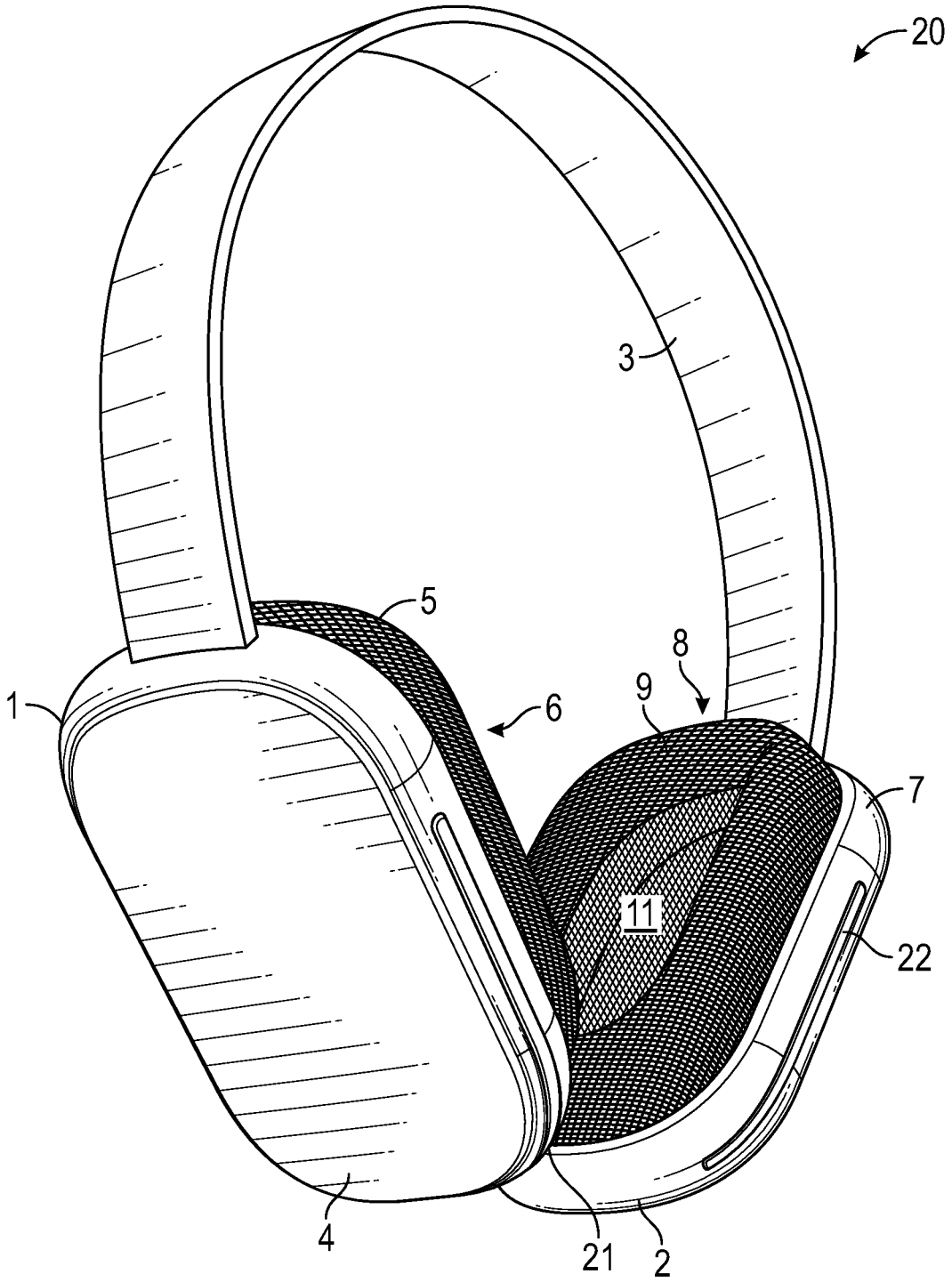
FIG. 4 shows another schematic perspective view of the embodiment of the headset of FIG. 3.

FIGS. 3 and 4 show a second embodiment of a monaural headset 20 in schematic perspective views. The headset 20 corresponds to headset 10 of FIGS. 1 and 2 with the exception of the arrangement of elongated microphone grilles 21, 22 as part of the earcup housings 4, 7 and corresponding microphones (not shown) arranged under the grilles 21, 22. The arrangement of microphones on both earphones 1, 2 provides a high performing transmit function, i.e., to capture and transmit the user's voice to a far-end communication participant, which high performing transmit function is usually not provided by monaural headsets.

Figure 5:
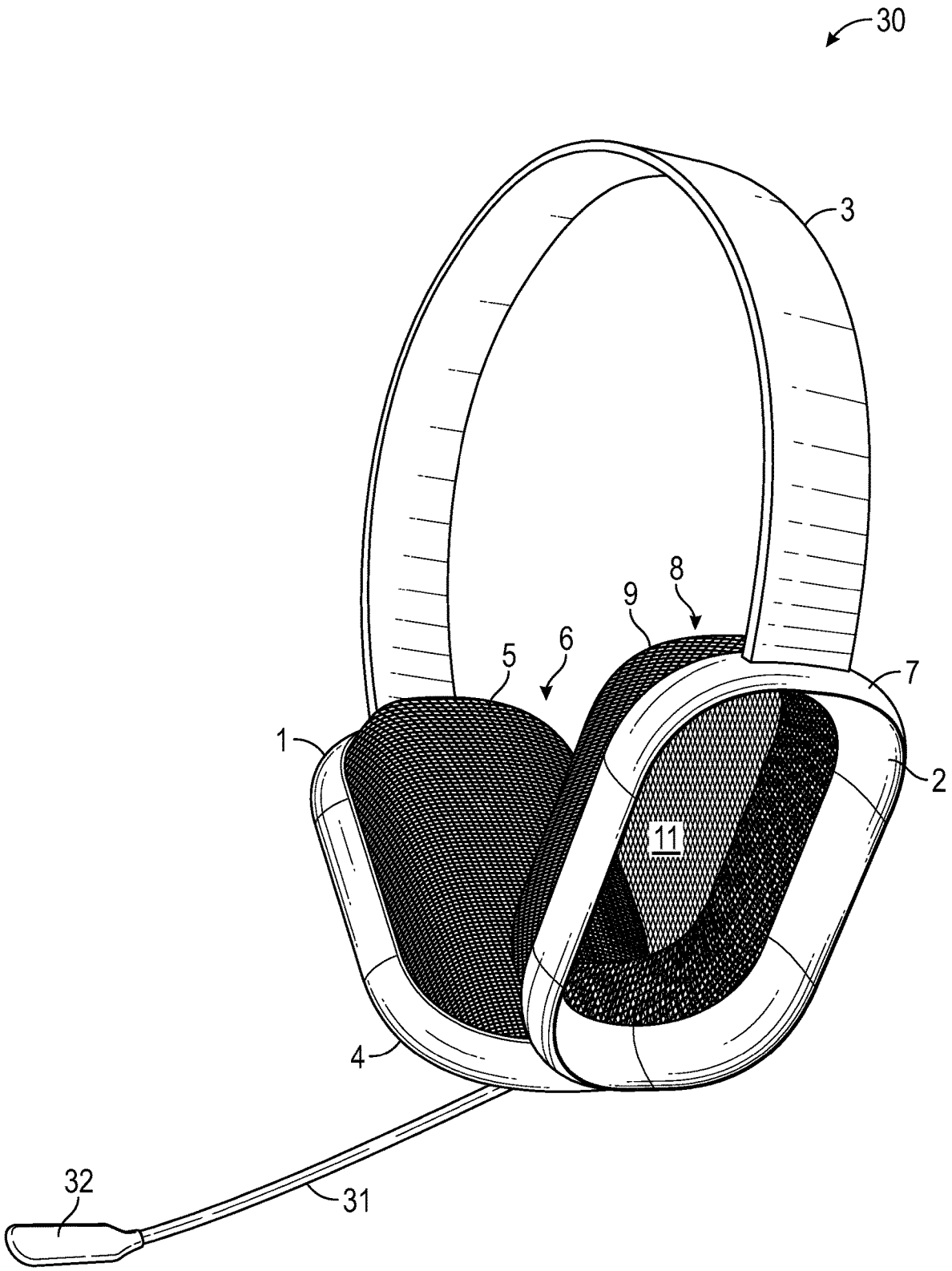
FIG. 5 shows a third embodiment of a monaural headset in a schematic perspective view.
Figure 6:
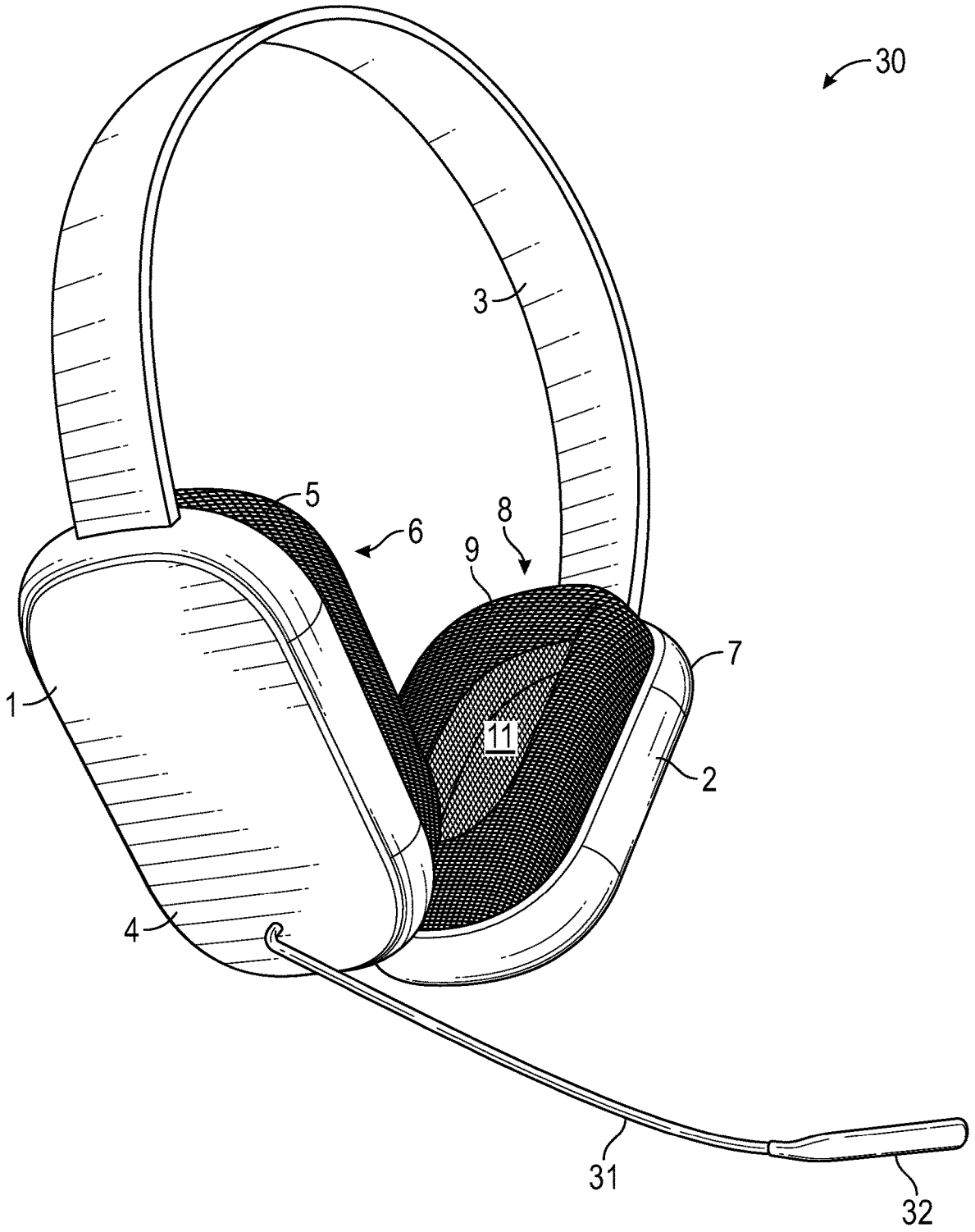
FIG. 6 shows another schematic perspective view of the embodiment of the headset of FIG. 5.
Figure 7:
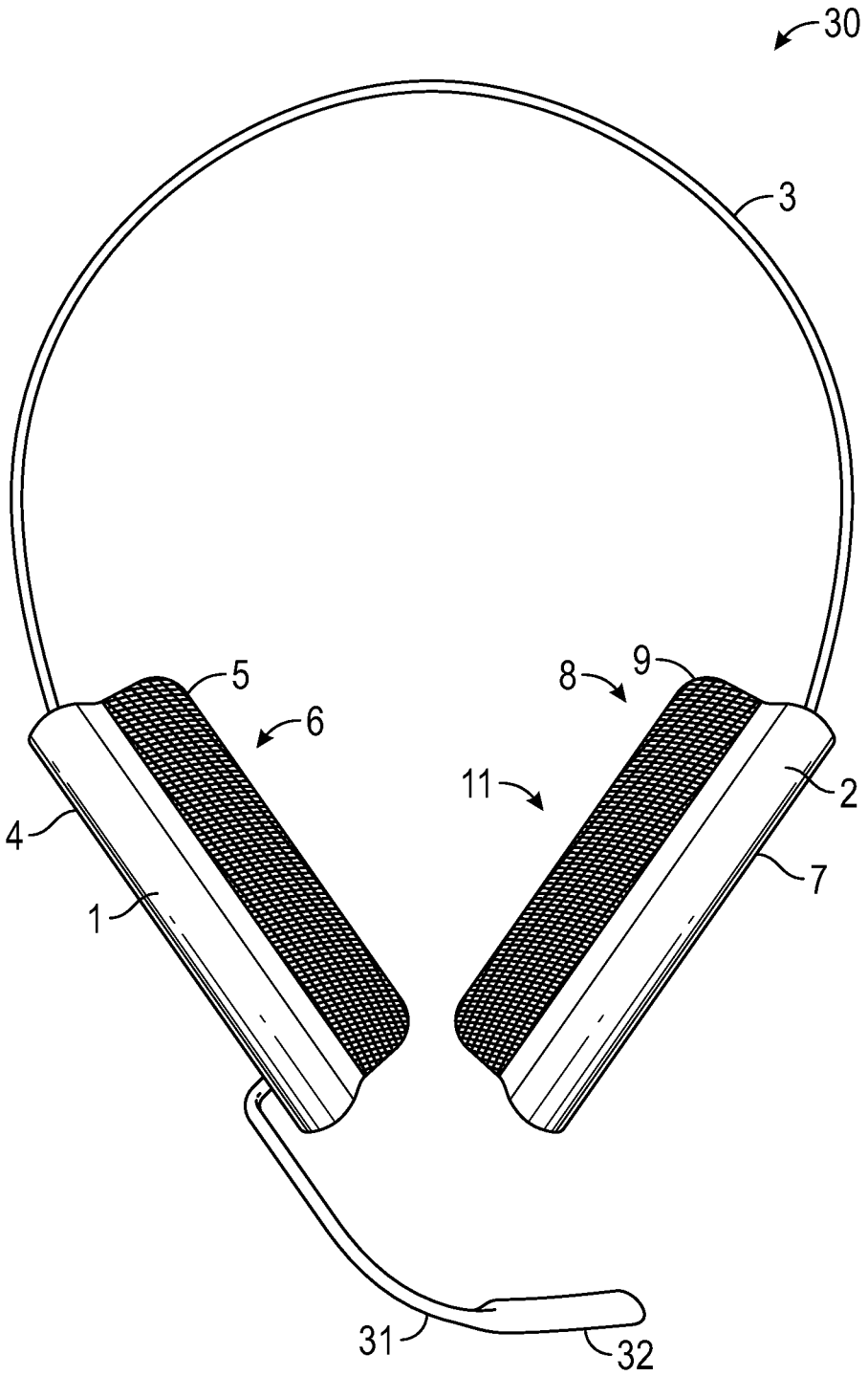
FIG. 7 shows a front view of the embodiment of the headset of FIG. 5.
Figure 8:
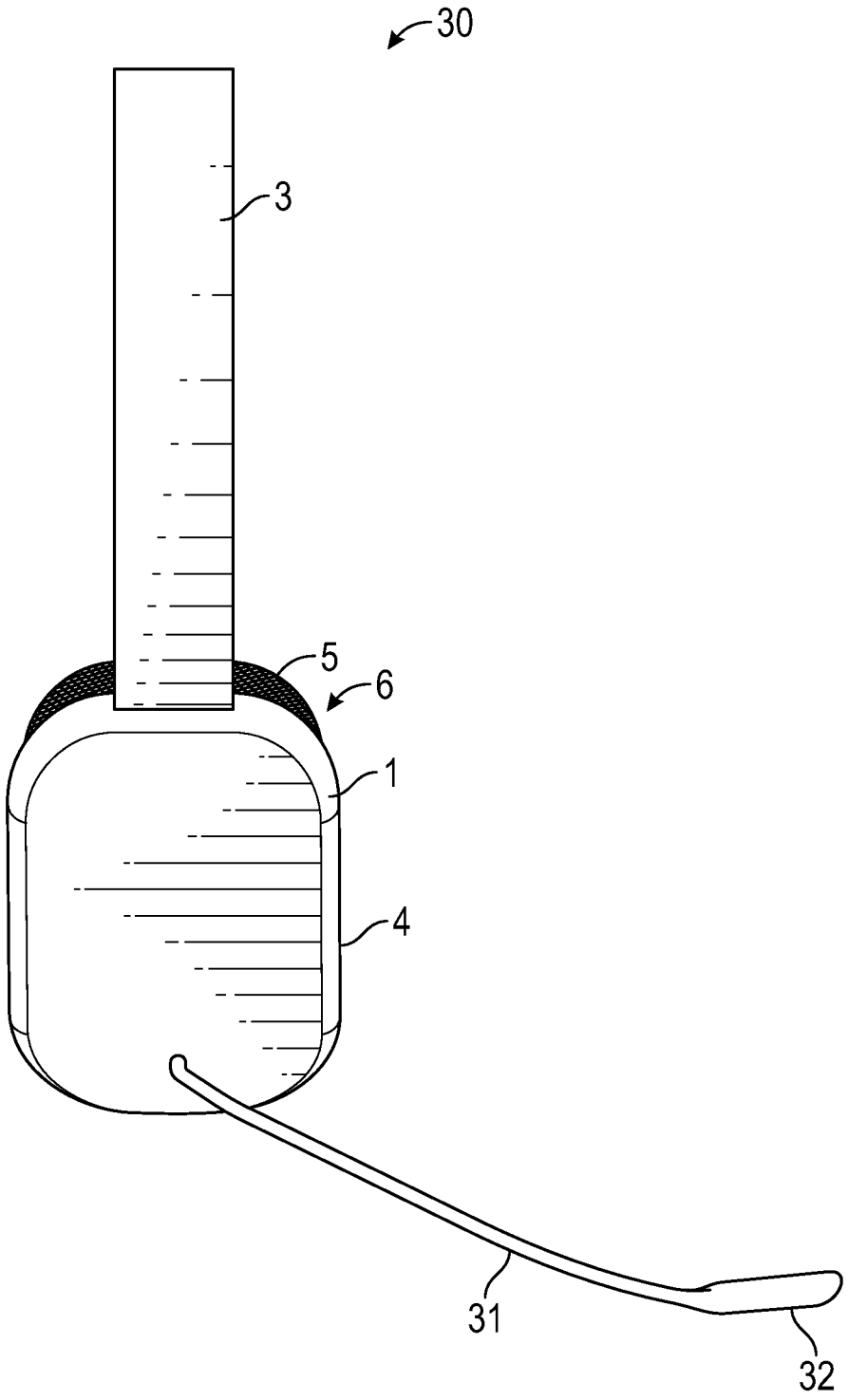
FIG. 8 shows a side view of the embodiment of the headset of FIG. 5.
Figure 9:
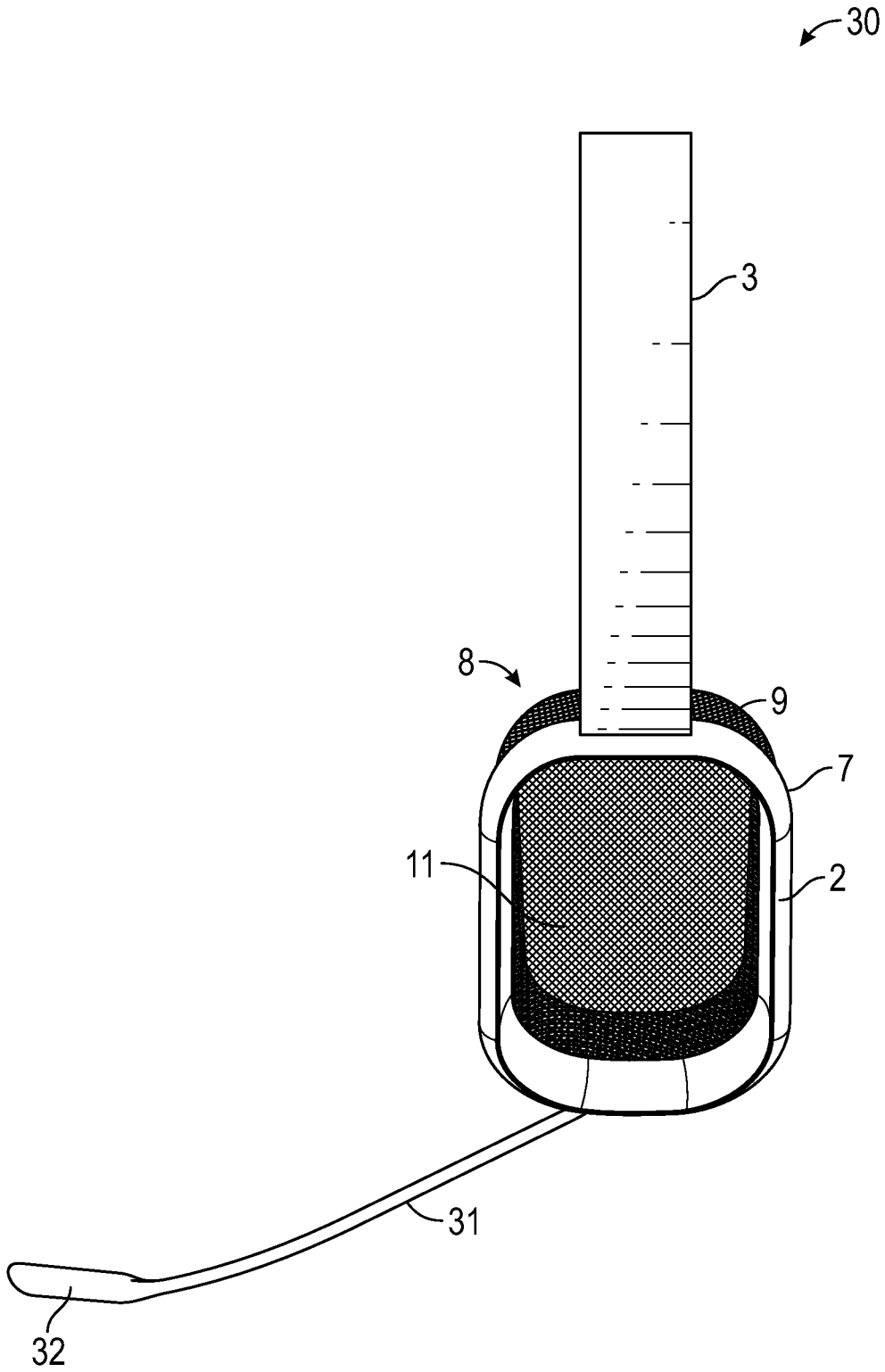
FIG. 9 shows another side view of the embodiment of the headset of FIG. 5.
Figure 10:
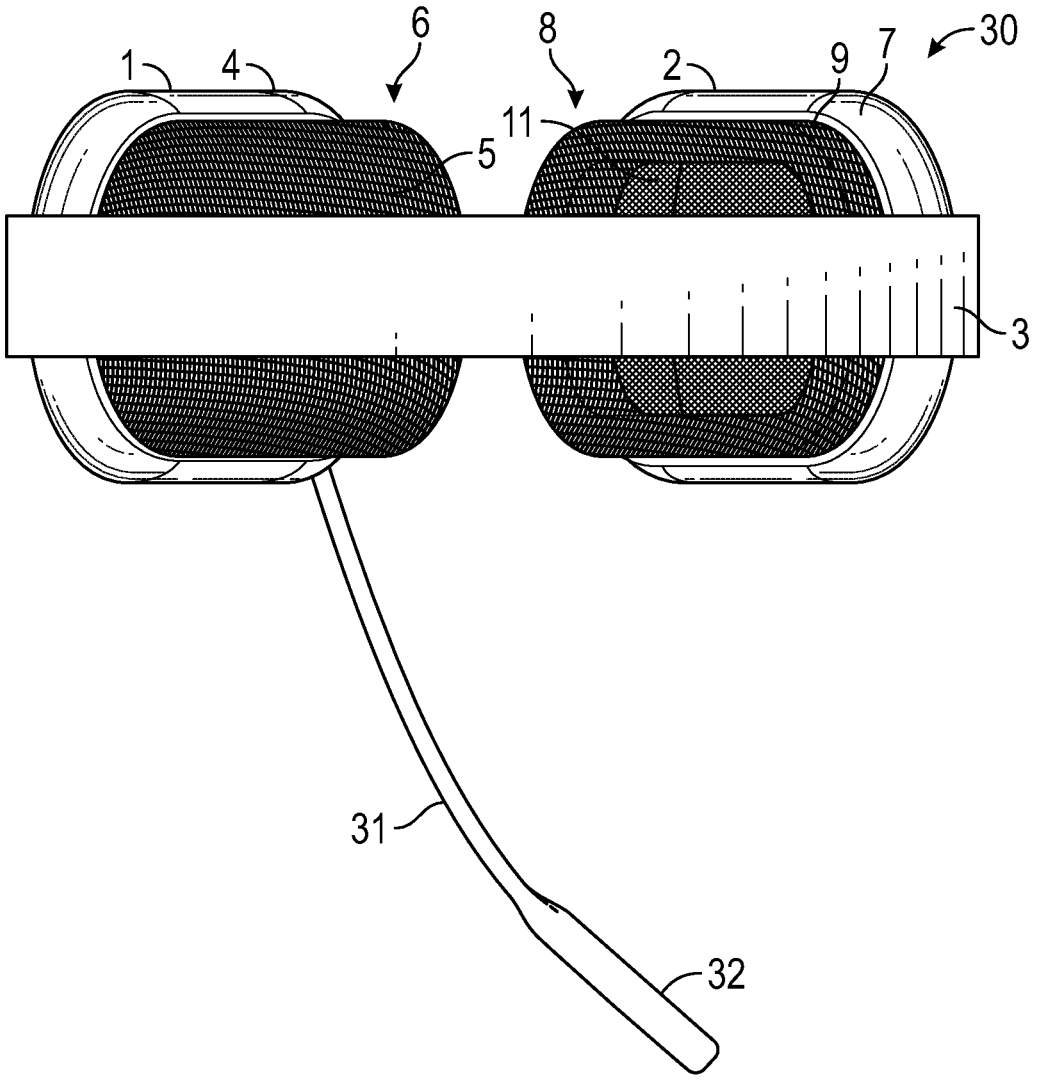
FIG. 10 shows a top view of the embodiment of the headset of FIG. 5.
Figure 11:
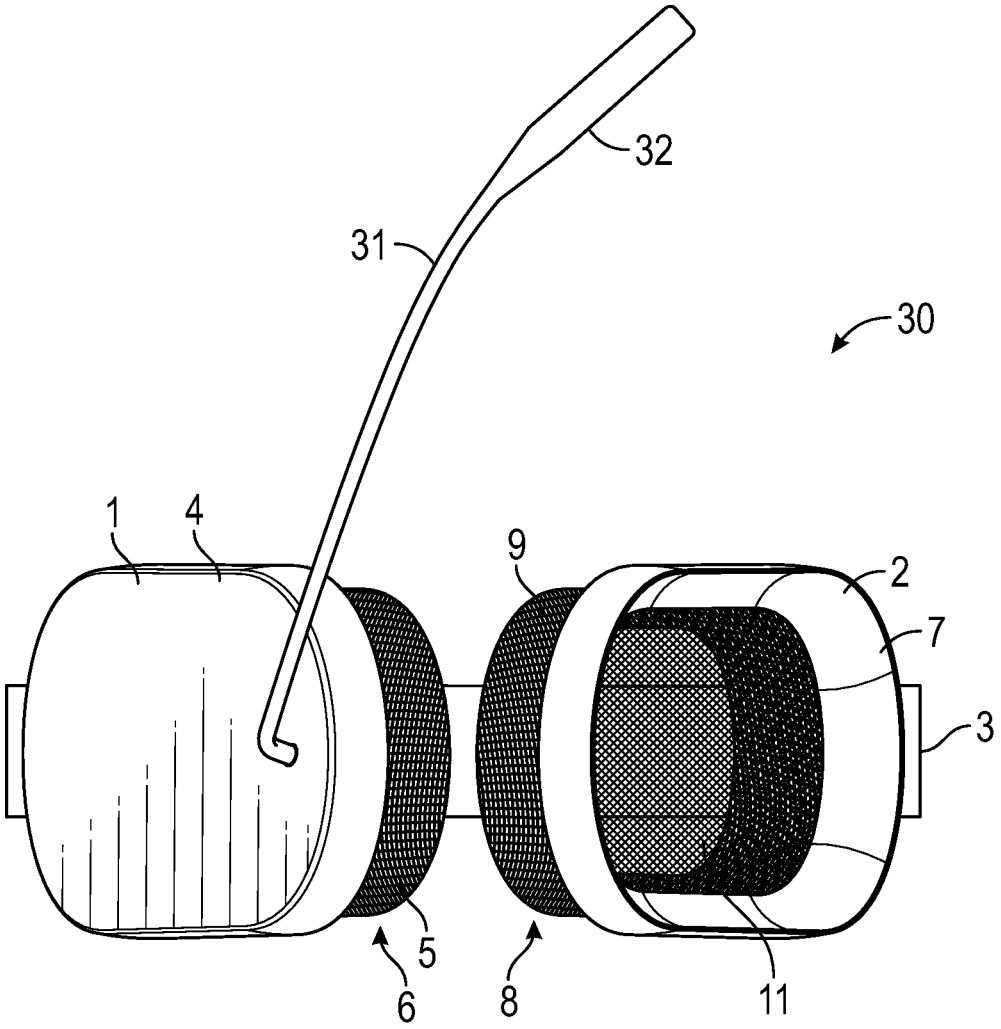
FIG. 11 shows a bottom view of the embodiment of the headset of FIG. 5.

FIGS. 5-11 show a third embodiment of a monaural headset 30 in schematic perspective views. The headset 30 corresponds to headset 10 of FIGS. 1 and 2 with the exception of the arrangement of a microphone boom 31 with a microphone 32 for the transmit function. Although not shown, it is possible to combine the shown setup of microphone boom 31 and microphone 32 with the microphone grilles 21, 22 and corresponding microphones of FIGS. 3 and 4 for a further improved transmit functionality. While FIGS. 5 and 6 show schematic perspective views of headset 30, FIG. 7 shows a schematic front view, FIGS. 8 and 9 show schematic side views, FIG. 10 shows a schematic top view, and FIG. 11 shows a schematic bottom view.

Figure 12:
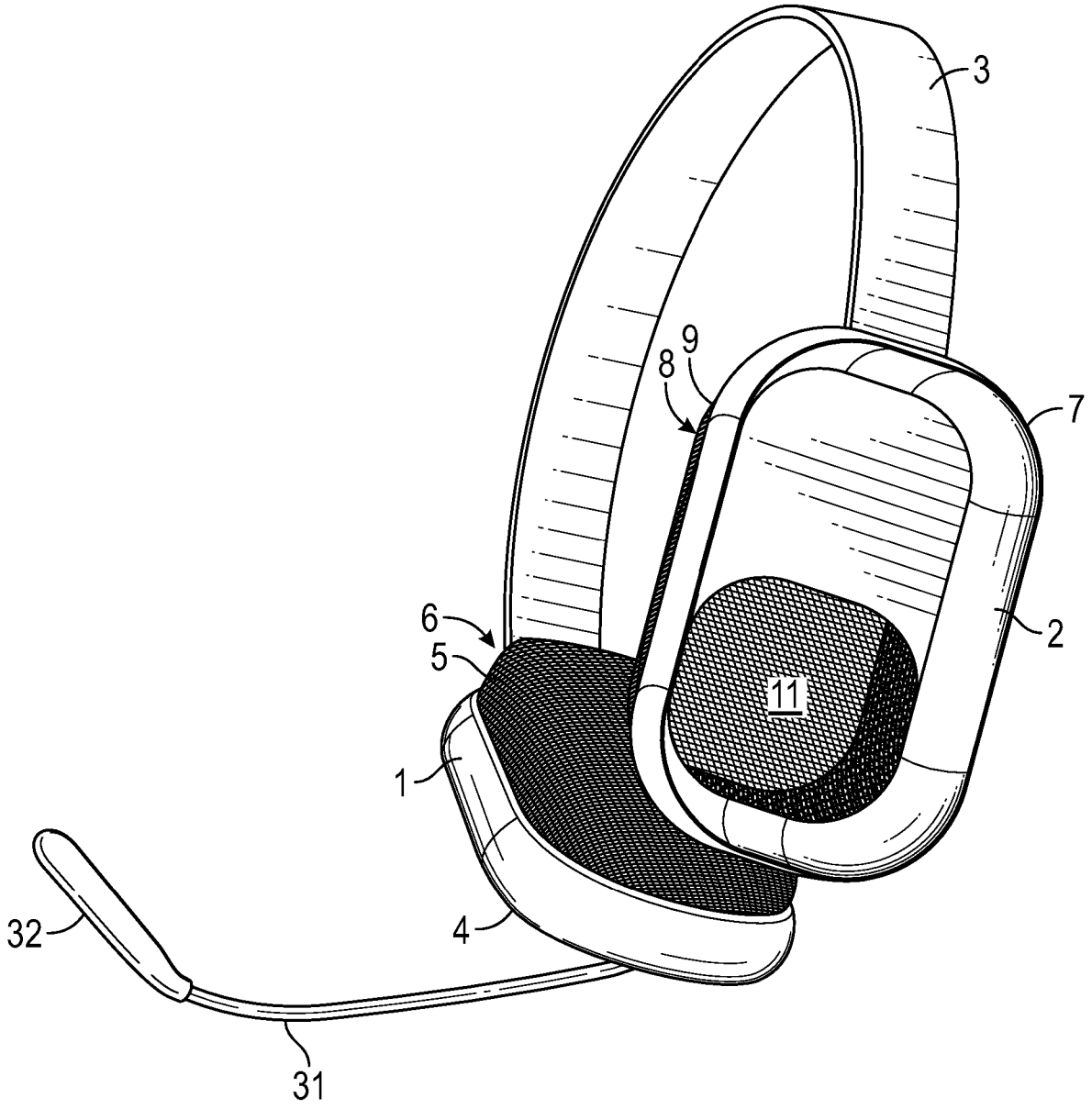
FIG. 12 shows a third embodiment of a monaural headset in a schematic perspective view.

FIG. 12 shows a fourth embodiment of a monaural headset 40 in a schematic perspective view. The headset 40 corresponds to headset 30 of FIGS. 5-11 with the exception of vent opening 11. As can be seen from the FIG., the vent opening 11 in the present embodiment is smaller, compared to the preceding embodiments. The vent opening 11 in the present embodiment is designed to keep the ear canal region of the user's ear uncovered, as can be also seen from FIGS. 20*a* and 20*b*. The remainder of the outer surface of second earphone 2 is formed by a plastic cover.

Figure 13:
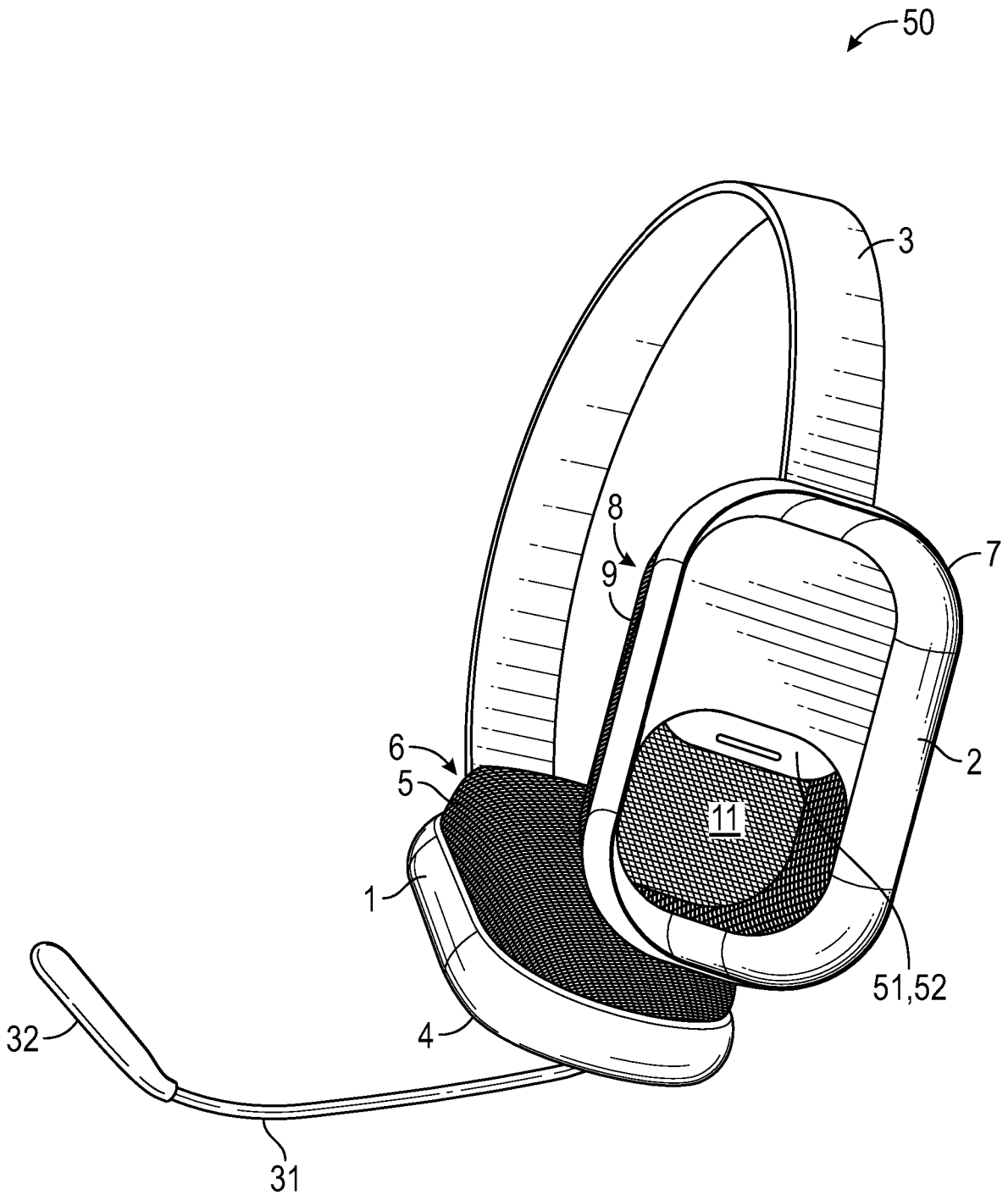
FIGS. 13 and 14 show a fourth embodiment of a monaural headset in schematic perspective views.
Figure 14:
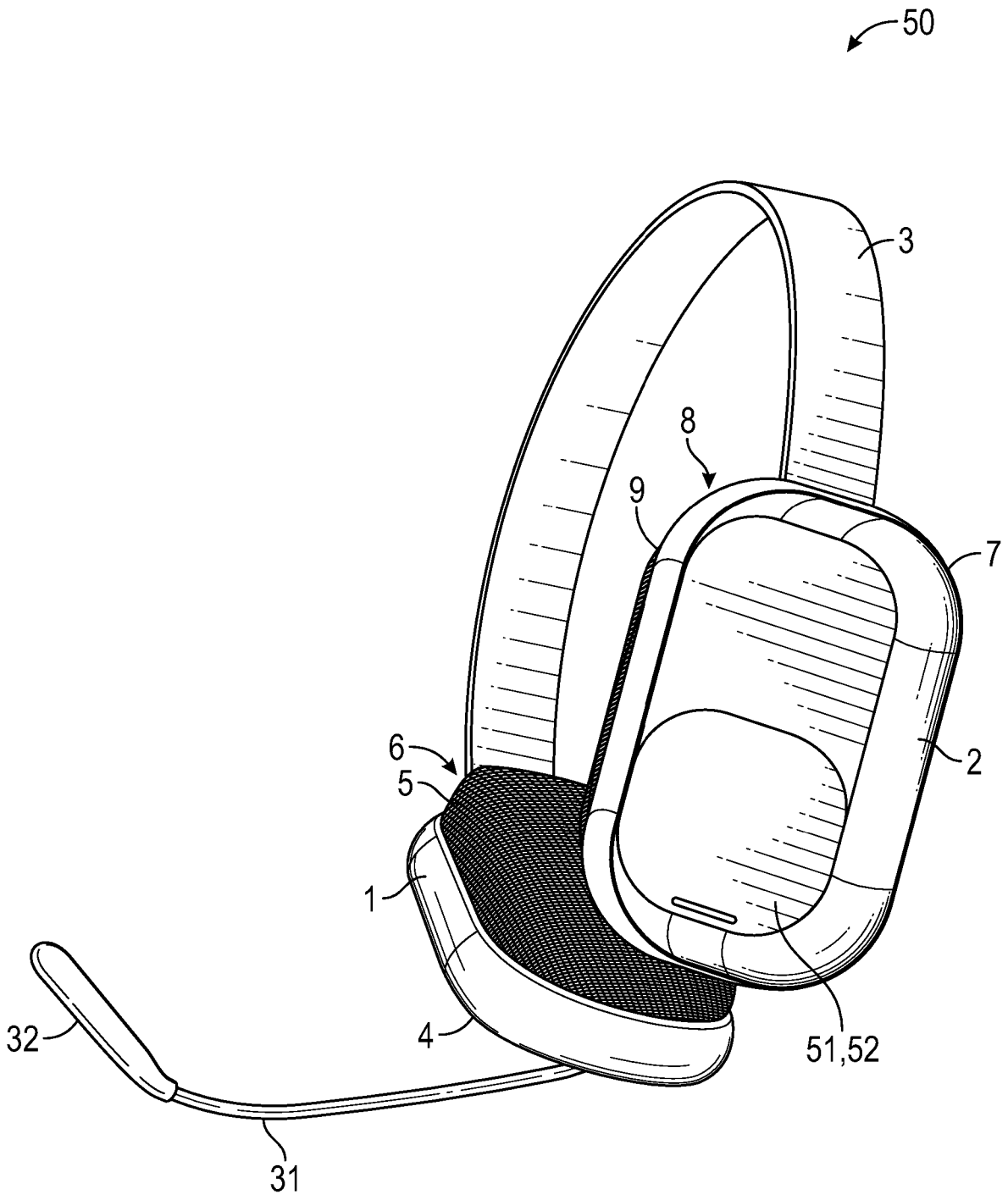
Figure 15C:
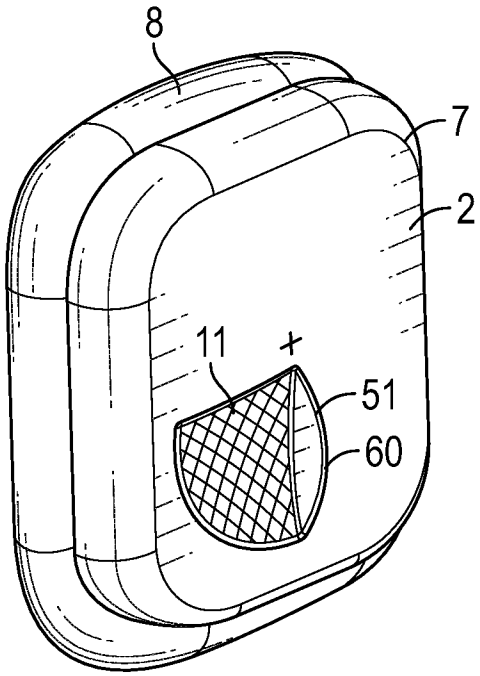
FIGS. 15*a*-15*c* show various alternative configurations for a closure mechanism for a monaural headset.
Figure 15B:
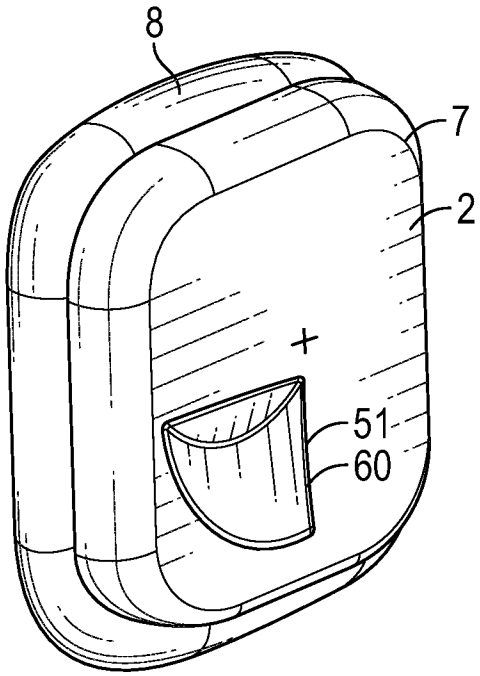
Figure 15A:
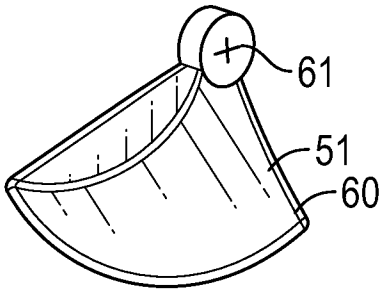
Figure 16D:
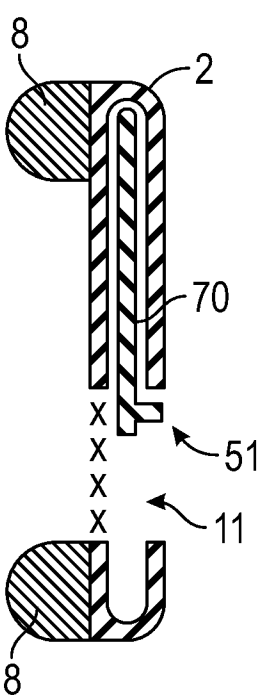
FIGS. 16*a*-16*d* show various alternative configurations for a closure mechanism for a monaural headset.
Figure 16C:
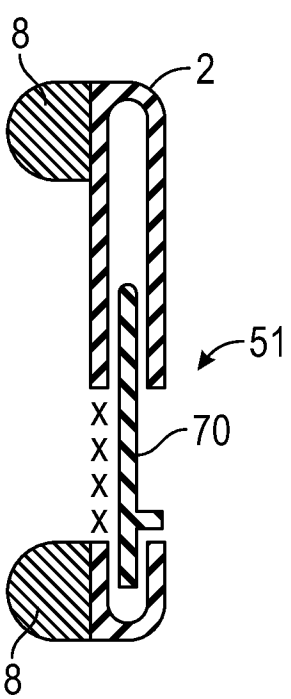
Figure 16B:
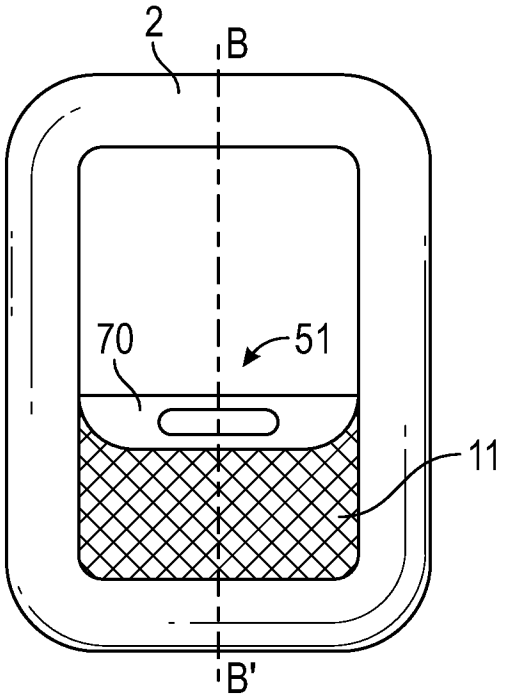
Figure 16A:
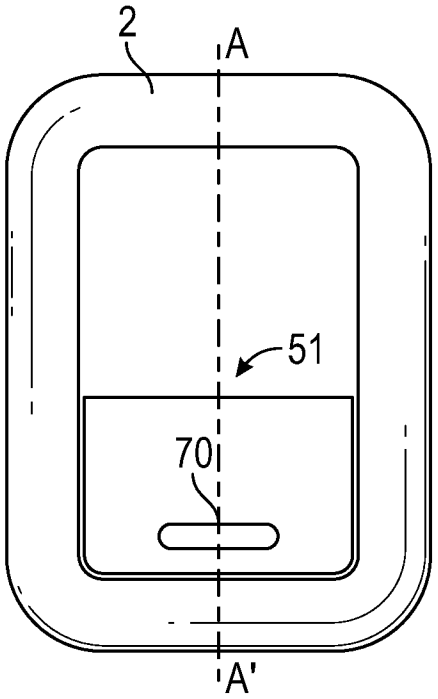

FIGS. 13 and 14 show a fifth embodiment of a monaural headset 50 in schematic perspective views. The headset 50 corresponds to headset 40 of FIG. 12 with the exception of an additional closure mechanism 51, which allows to selectively cover and uncover vent opening 11. In the present embodiment, the closure mechanism 51 is formed by a cover plate 52 made from plastic material. FIG. 13 shows the cover plate 52 in an almost retracted or open position, leaving vent opening 11 substantially open. Accordingly, environmental sounds during use can reach the ear of the user though vent opening 11. FIG. 13 shows the cover plate 52 in a closed position covering the vent opening 11 completely. In the closed position, the second earphone 2 provides acoustic isolation to the respective user's ear when the headset 50 is worn.

FIGS. 15-19 show various alternative configurations for closure mechanism 51 for the second earphone 2 in perspective views. FIG. 15*a* shows a closure mechanism 51 with a 'dial-type' cover 60 that is rotatable about axis 61. FIG. 15*b* shows earphone 2 with the closure mechanism 51, comprising the 'dial-type' cover 60, in the closed position. FIG. 15*c* shows earphone 2 with the closure mechanism 51 in the open position. Vent opening 11 can be seen in FIG. 15*c*, through which environmental sounds can reach the ear of the user during use. An elastomer (not shown) can optionally be used for friction adjustment or to provide a seal.

FIG. 16 show another embodiment of closure mechanism 51 for second earphone 2, namely with a vertically sliding cover plate 70. FIGS. 16*a* and 16*b* show schematic side views, while FIGS. 16*c* and 16*d* show schematic cross-sectional views. FIG. 16*c* is a cross-sectional view of earphone 2 along line A-A' of FIG. 16*a*. FIG. 16*d* is a cross-sectional view of earphone 2 along line B-B" of FIG. 16*b*. As follows from the drawings, FIGS. 16*a* and 16*c* show the closure mechanism 51 in the closed position, while FIGS. 16*b* and 16*d* show the closure mechanism 51 in the open position. An elastomer (not shown) can optionally be used for friction adjustment and/or to provide a seal.

Figure 17A:
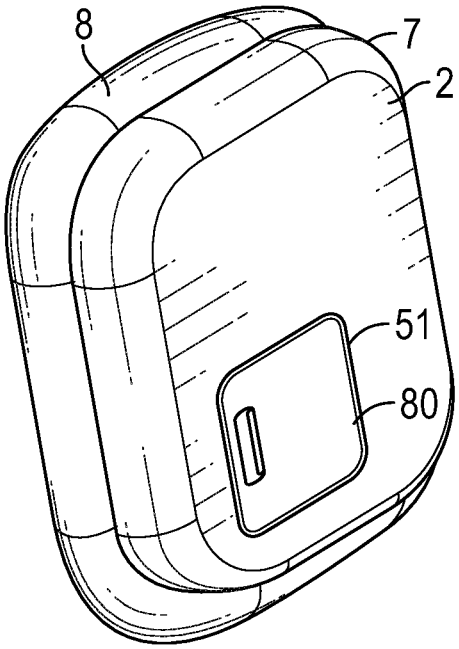
FIGS. 17*a*-17*b* show various alternative configurations for a closure mechanism for a monaural headset.
Figure 17B:
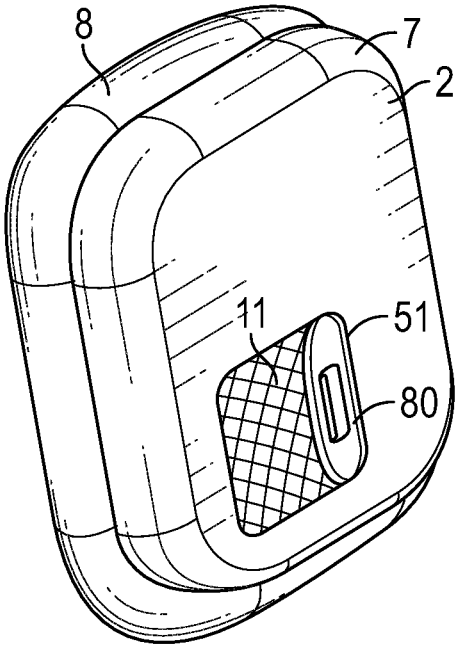

FIGS. 17*a* and 17*b* show another embodiment of closure mechanism 51 for second earphone 2, namely with a horizontally sliding cover plate 80. The embodiment of FIGS. 17*a* and 17*b* correspond to the embodiment of FIG. 16 with the exception of sliding cover plate 80. The cover plate 80 in this embodiment slides in grooves (not shown) in the housing 7 or between two respective parts of housing 7. An elastomer (not shown) can optionally be used for friction adjustment and/or to provide a seal.

FIG. 18 show another embodiment of closure mechanism 51 for second earphone 2, namely a sliding cover plate 90 with an operating handle 91. In the present embodiment, second earphone 2 uses a 'slotted design' with two vent openings 11.

Figure 18D:
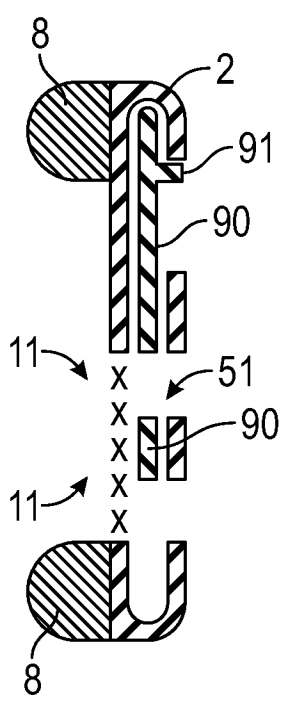
FIGS. 18*a*-18*d* show various alternative configurations for a closure mechanism for a monaural headset.
Figure 18C:
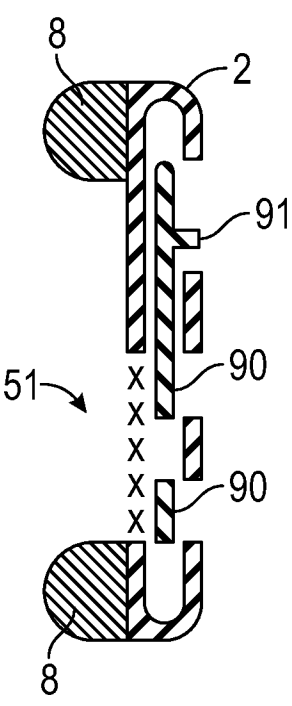
Figure 18B:
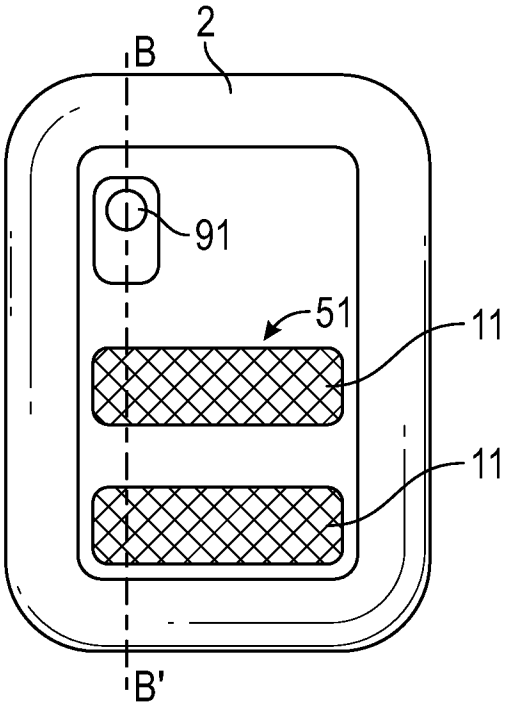
Figure 18A:
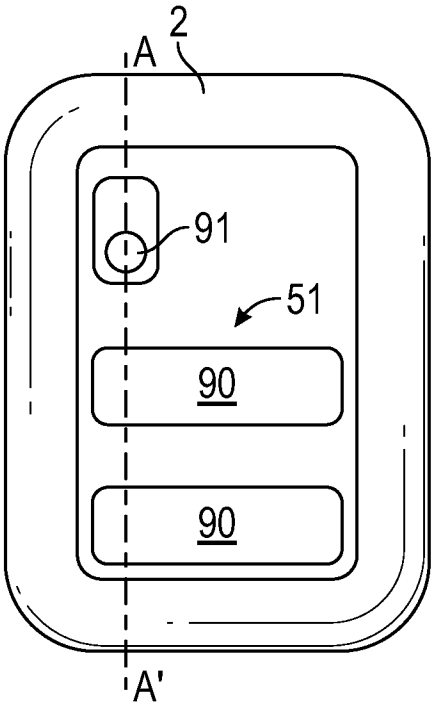

FIGS. 18*a* and 18*b* show schematic side views, while FIGS. 18*c* and 18*d* show schematic cross-sectional views. FIG. 18*c* shows a cross-sectional view of earphone 2 along line A-A' of FIG. 18*a*. FIG. 18*d* shows a cross-sectional view of earphone 2 along line B-B' of FIG. 18*b*. FIGS. 18*a* and 18*c* show the closure mechanism 51 in the closed position, while FIGS. 18*b* and 18*d* show the closure mechanism 51 in the open position. An elastomer (not shown) can optionally be used for friction adjustment and/or to provide a seal.

Figure 19C:
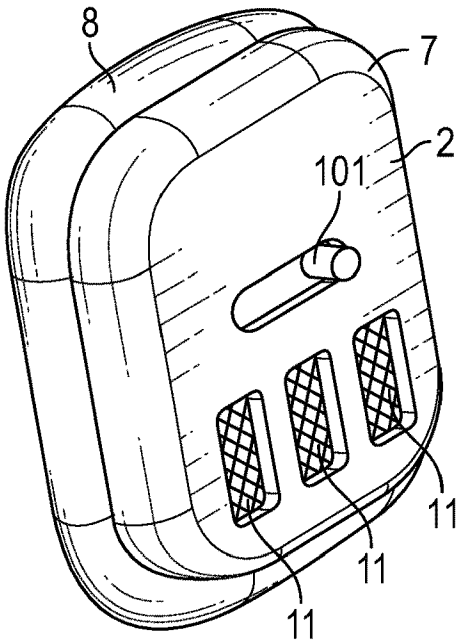
FIGS. 19*a*-19*c* show various alternative configurations for a closure mechanism for a monaural headset.
Figure 19B:
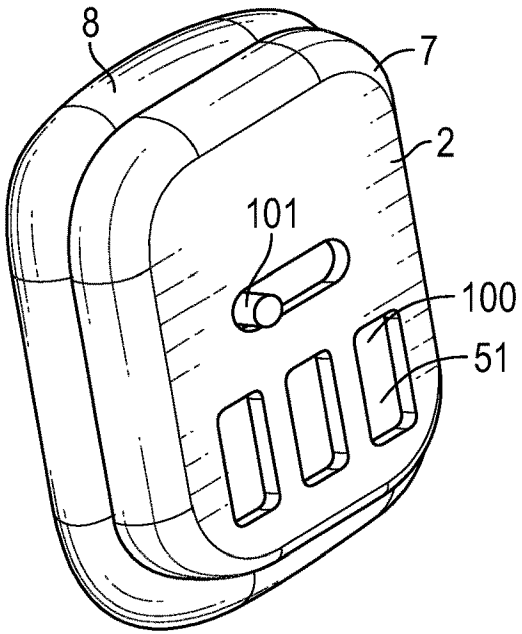
Figure 19A:
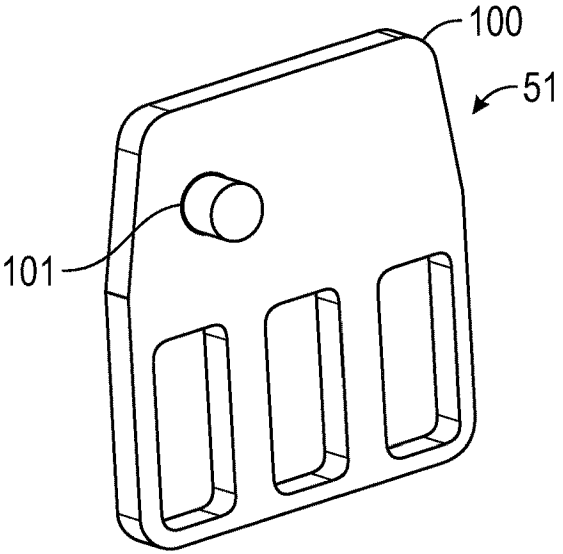

FIG. 19 show another embodiment of closure mechanism 51 for second earphone 2, namely a sliding cover plate 100 with an operating handle 101. The embodiment of FIG. 19 is similar to the embodiment of FIG. 18 in that the second earphone 2 uses a 'slotted design' with three vent openings 11. FIG. 19*a* shows the cover plate 100 with operating handle 101, but without the earphone 2. FIG. 19*b* shows earphone 2 with the closure mechanism 51 in the closed position. FIG. 19*c* shows earphone 2 with the closure mechanism 51 in the open position.

Figure 20A:
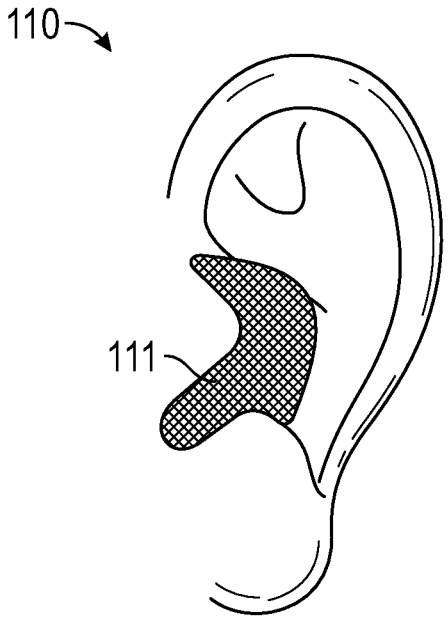
FIG. 20*a* shows a schematic drawing of a human ear.
Figure 20B:
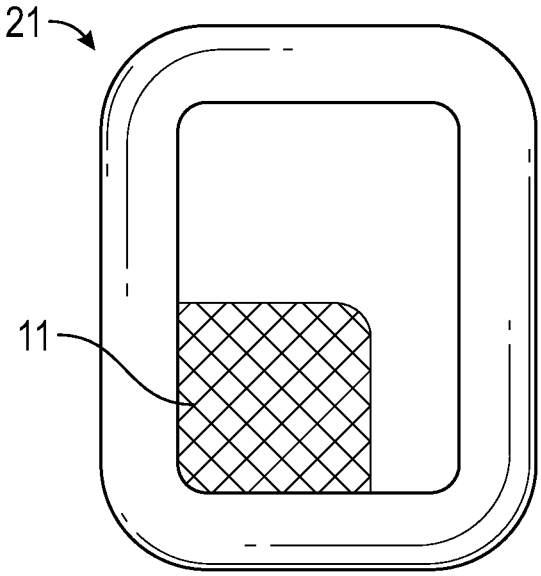
FIG. 20*b* shows a schematic front view of an exemplary circum-aural earphone.
Figure 20C:
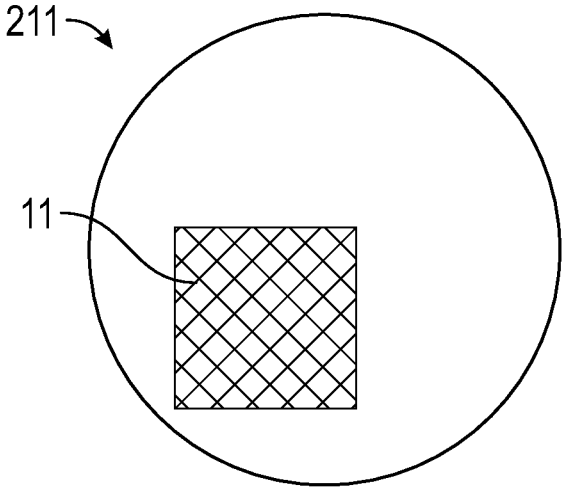
FIG. 20*c* shows a schematic front view of an exemplary super-aural earphone.

FIG. 20*a* shows a schematic drawing of a human ear 110 of a user with ear canal region 111. To provide the user with an improved spatial 'feel' of the user's surroundings, a direct acoustic path to the ear canal region 111 may be provided by configuring and arranging vent opening 11 within the second earphone 2 so that during use, the vent opening 11 aligns with ear canal region 111. FIG. 20*b* shows such an arrangement for an exemplary circum-aural earphone 2*a*. FIG. 20*c* shows a corresponding arrangement for an exemplary super-aural earphone 2*b*.

Figure 21:
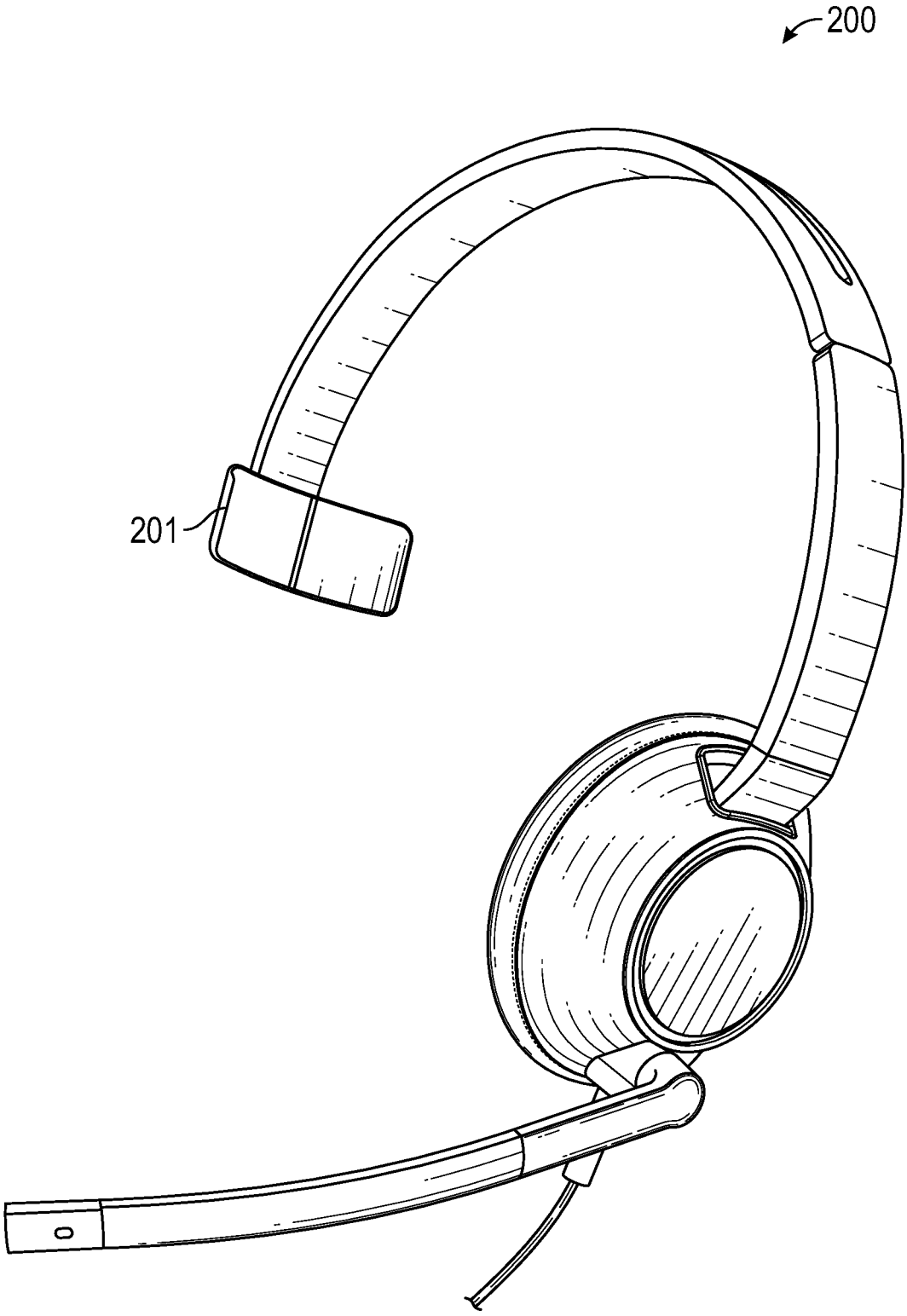
FIG. 21 shows a schematic perspective view of a headset with a T-pad.

FIG. 21 shows a schematic drawing of a headset 200 with a T-pad 201.

The invention has been described in the preceding using various exemplary embodiments. Other variations to the disclosed embodiments can be understood and effected by those skilled in the art in practicing the claimed invention, from a study of the drawings, the disclosure, and the appended claims. For example, it is possible to operate the invention in an embodiment in which:

headset 10, 20, 30, 40, 50 may be configured for a wired connection to an audio source using a conductive connection, such as a cable connection, instead of or in addition to the discussed wireless mode of operation;

headset 10, 20, 30, 40, 50 may be configured as a supra-aural headset, instead of being configured as a circum-aural headset; and/or headset 10, 20, 30, 40, 50 may be configured with one or more microphones to capture and transmit the user's voice to a remote (far-end) communication participant or to a recording device.

Specific embodiments of the invention have been described in detail. In the description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the preceding explanation of the present invention according to the embodiments described the terms "coupled (to/with)" and "connected (to/with)" are used to indicate a physical connection between at least two parts, components, or objects. Such a connection may be direct between the respective parts, components, or objects; or indirect, i.e., over intermediate parts, components, or objects. It is noted that the above terms may also be used in an electrical or communication context herein. In such cases, the terms may relate to an electrical (conductive) connection, or a wire-based or wireless data and/or audio connection.

In the preceding description, ordinal numbers (e.g., first, second, third, etc.) may have been used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

In the claims, the word "comprising" does not exclude other elements or steps, and the indefinite article "a" or "an" does not exclude a plurality. A single processor, module or other unit or device may fulfil the functions of several items recited in the claims.

The term "exemplary" used throughout the specification means "serving as an example, instance, or exemplification" and does not mean "preferred" or "having advantages" over other embodiments.

The mere fact that certain measures are recited in mutually different dependent claims or embodiments does not indicate that a combination of these measures cannot be used to advantage. Any reference signs in the claims should not be construed as limiting the scope.

What is claimed is:

1. A monaural headset, comprising at least:

a first earphone with a speaker to provide output audio to a user;

a second earphone without a speaker; and a headband, connected to the first earphone and the second earphone; wherein the second earphone comprises at least one vent opening and a closure mechanism, wherein the vent opening during use provides an acoustic path between an environment of the user, wearing the headset, and a user's ear; and wherein the closure mechanism comprises a sliding door for selectively blocking the at least one vent opening.

2. The headset of claim 1, wherein at least one of the first and second earphones are formed as circum-aural or supra-aural earphones.

3. The headset of claim 1, wherein an exterior configuration of the first earphone is substantially similar to an exterior configuration of the second earphone.

4. The headset of claim 1, wherein one or more of the first earphone and the second earphone comprise an ear cushion.

5. The headset of claim 1, wherein the at least one vent opening comprises a screen.

6. The headset of claim 5, wherein the screen is made from a woven fabric.

7. The headset of claim 1, wherein the closure mechanism is configured to provide at least an open position and a closed position, wherein in the closed position the acoustic path is blocked, and in the open position, the at least one vent opening provides the acoustic path.

8. The headset of claim 1, the closure mechanism comprises a sliding door for selectively blocking the at least one vent opening, wherein the closure mechanism comprises a raised or indented handle to allow a user to operate the closure mechanism.

9. The headset of claim 1, wherein the at least one vent opening of the second earphone has a cross-sectional area size of approximately 100 mm2 to 1600 mm2.

10. The headset of claim 1, wherein the second earphone comprises an ear cushion; wherein the ear cushion is substantially ring-shaped around a central axis, wherein the at least one vent opening is formed along the central axis of the ear cushion.

11. The headset of claim 10, wherein the second earphone comprises a housing, which housing couples the ear cushion to the headband.

12. The headset of claim 11, wherein the housing is substantially ring-shaped around the central axis.

13. The headset of claim 1, wherein one or more of the first earphone and the second earphone comprise at least one microphone.

14. The headset of claim 1, wherein the at least one microphone is mounted on a microphone boom, which microphone boom is connected to the first earphone or the second earphone.

15. The headset of claim 1, further comprising a plurality of microphones, arranged as part of at least one of the first earphone and the second earphone.

16. A monaural headset, comprising at least:

a first earphone comprising a speaker;

a second earphone; and a headband, connected to the first earphone and the second earphone; wherein the second earphone is speakerless; and the second earphone comprises a vent opening and a closure mechanism, which vent opening provides a direct acoustic path between an environment of a user, wearing the headset, and the user's ear; and wherein the closure mechanism comprises a sliding door for selectively blocking the at least one vent opening.

17. A monaural headset, comprising at least:

a first earphone with a speaker;

a second earphone without a speaker; and a headband, connecting the first and second earphones; wherein the second earphone is of open or semi-open type and comprises a vent opening with a closure mechanism, the closure mechanism comprising a sliding door for selectively blocking at least one vent opening.

* * * * *